United States Patent [19]

Kneip, Jr. et al.

[11] Patent Number: 4,601,175

[45] Date of Patent: Jul. 22, 1986

[54] REDUCTION OF WATER CONDENSATION ON NECK TUBES OF CRYOGENIC CONTAINERS

[75] Inventors: George D. Kneip, Jr., Menlo Park; John H. Broshear, E. Alviso; Marvin H. Anderson, Mountain View, all of Calif.

[73] Assignee: Varian Associates, Inc., Palo Alto, Calif.

[21] Appl. No.: 670,122

[22] Filed: Nov. 13, 1984

Related U.S. Application Data

[63] Continuation of Ser. No. 536,489, Sep. 28, 1983, abandoned.

[51] Int. Cl.[4] ..... F17C 7/02

[52] U.S. Cl. ..... 62/50; 62/514 R; 165/181

[58] Field of Search ..... 62/50, 52, 514 R; 165/181

[56] References Cited

U.S. PATENT DOCUMENTS

| | | | |
|---|---|---|---|
| 3,318,104 | 5/1967 | Roszkowski | 62/50 |
| 3,346,718 | 10/1967 | Cooley | 62/50 |
| 3,608,324 | 9/1971 | Singleton | 62/50 |
| 3,735,465 | 5/1973 | Tibbetts et al. | 62/52 |
| 3,938,346 | 2/1976 | Ovchinnikov et al. | 62/514 R |
| 4,350,017 | 9/1982 | Kneip, Jr. et al. | 62/52 |
| 4,399,660 | 8/1983 | Volger, Jr. et al. | 62/52 |

*Primary Examiner*—Ronald C. Capossela

*Attorney, Agent, or Firm*—Stanley Z. Cole; Edward H. Berkowitz

[57] ABSTRACT

Vapor from a boiling cryogenic liquid contained in a cryostat is warmed prior to discharge by passing said vapor through a heat exchanger for transferring heat at ambient temperature to the escaping vapor whereby condensation of atmospheric moisture on the cryostat is minimized.

1 Claim, 4 Drawing Figures

REDUCTION OF WATER CONDENSATION ON NECK TUBES OF CRYOGENIC CONTAINERS

This is a continuation of application Ser. No. 536,489, filed 09/28/83 abandoned.

FIELD OF THE INVENTION

The present invention pertains to reduction of the accumulation of moisture and ice on the exterior surfaces of vent and fill tubes of cryostats for liquified gas containment.

BACKGROUND OF THE INVENTION

Boiling vapor exhausting from prior art cryostats is usually discharged to the atmosphere at relatively low temperature in comparison with ambient conditions. That is, the cold escaping vapor is cool enough to transfer heat from the vent tube at such a rate as to lower the temperature of this structure to well below the freezing point of atmospheric moisture. This moisture condenses thereon, freezes and continues to accumulate. In proximity to the accumulating ice, there is necessarily a region cooled to an intermediate temperature, upon which moisture condenses and flows without freezing. Thus, even in this steady state, liquid is evolving. As a result, corrosion can appear on a cryostat and this is particularly dangerous because the neck tube is ordinarily welded to the body of the cryostat. Corrorion appearing at this point weakens the welded joint and may destroy the vacuum integrity of the cryostat internal structure. The neck tube(s) support much of the inner structure: severe corrosion may result in mechanical weakening of the same interior structure.

To reduce this accumulation, the prior art has resorted, in one example, to electrical means to supply heat to the escaping gas. Another approach has utilized wicking material to absorb moisture and transport same by capillary attraction to a reservoir. Still another approach can utilize very long venting tubes to afford additional surface for warming the vapor, but this can be unwieldy for filling the cryostat through inordinately long neck tubes.

It is an object of the invention to reduce the accumulation of ice and moisture on the exterior of the fill and vent tubes of a cryogenic container.

In the present invention a finned heat exchanger is disposed to supply heat derived from the atmosphere at ambient temperature to the boiling vapor traversing the interior of the fill and vent tube(s).

DETAILED DESCRIPTION OF THE INVENTION

Figure 1:
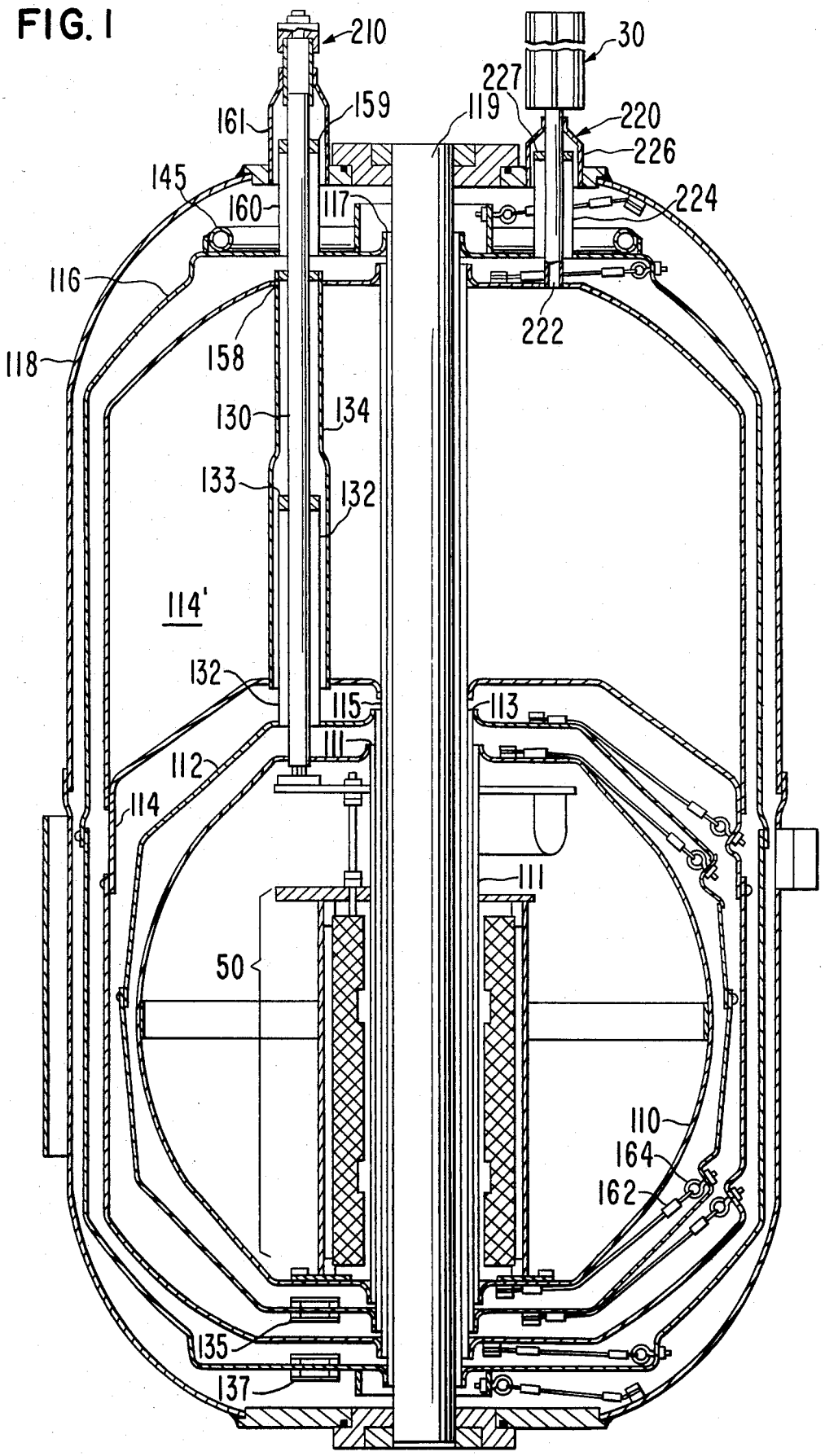
FIG. 1 is a cryostat illustrating the context of the invention.

The context of the present invention is apparent from FIG. 1 which shows a cryostat suitable for maintaining superconducting apparatus in a central region at the boiling point of liquid helium. This particular cryostat employs an outer jacket of liquid nitrogen which serves to establish an isothermal surface of intermediate temperatures surrounding the liquid helium reservoir. The present invention is appropriate to any cryostat for containment of a liquified gas, but the example is typical in many respects.

The cryostat of FIG. 1 comprises an outer vessel 118, an intermediate vessel 114' containing liquid nitrogen and an inner liquid helium reservoir 110. Disposed inside the liquid helium reservoir is an apparatus 50 which in the present example may be a superconducting magnet. There is disposed a radiation shield 112 intermediate isothermal shell 114 (at $L_2$ temperature) and the central liquid helium reservoir 110. Another radiation shield 116 is disposed between $LN_2$ isothermal shell 114 and outer vessel 118. These various structures must be maintained spaced apart in a mechanically stable manner, except for mechanical supports which are provided as described. Specific examples also disclose a cryostat characterized by bore 119, which requires corresponding bore structure in each of the nested components.

The ability to fill and vent respective cryogen reservoirs and to provide structural support is obtained with various neck tube assemblies. Two such neck tube assemblies are shown in FIG. 1. Neck tube assembly 210, for example, is one of two neck tubes communicating with liquid helium reservoir 110. Neck tube assembly 220 comprises concentric tubular members including the central tube 130 and heat shielding tubes 132, 134, 160 and 161. Another neck tube assembly 220 (one of three) communicates with the $LN_2$ reservoir 114' and comprises control tube 222 and concentric heat shields 224 and 226. Relative spacing is established by the mechanical coupling of the neck tube assemblies to the several structural members of the cryostat. Thermal contact is made at these points and the choice of position for the coupling is selected to transfer heat from the corresponding structure to the neck tube at a desired temperature into thermal gradient from liquid helium temperature to ambient. Non-thermal tensile coupling between components is illustrated by a high thermal impedance cordage 162 employed to stabilize the assembly.

In the cryostat pictured, heat is transferred to the liquid helium neck tube at collars 133, 158 and 159, thereby supplying heat to the escaping helium vapor. Flow rate for liquid helium in practice has been found to be sufficiently low together with the relatively high heat capacity thereof that no appreciable condensation problem is experienced at the exit of the helium neck tube. In this situation, the invention need not be applied to this vent tube. Heat transferred to the $N_2$ venting neck tube(s) occurs at collar 227 from at the outer radiation shield 116 before venting to atmosphere. Vapor flow of $N_2$ in these systems is relatively high, and even though the heat capacity is low relative to the helium vapor, the condensation problem is substantial at the exit of the $N_2$ neck tube.

Figure 2:
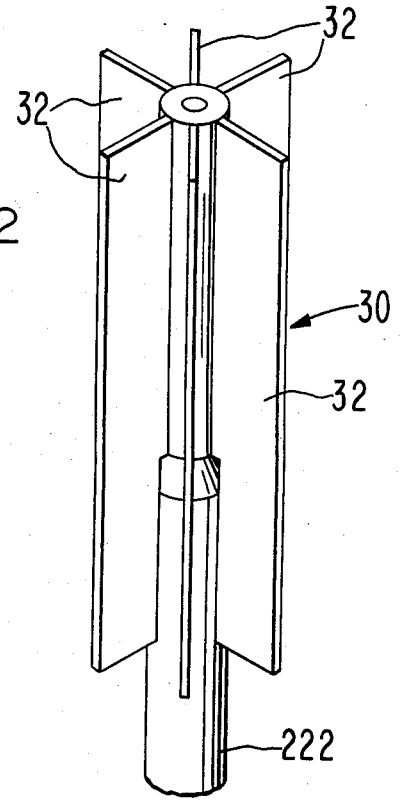
FIG. 2 is a finned heat exchanger for practice of the present invention.
Figure 4:
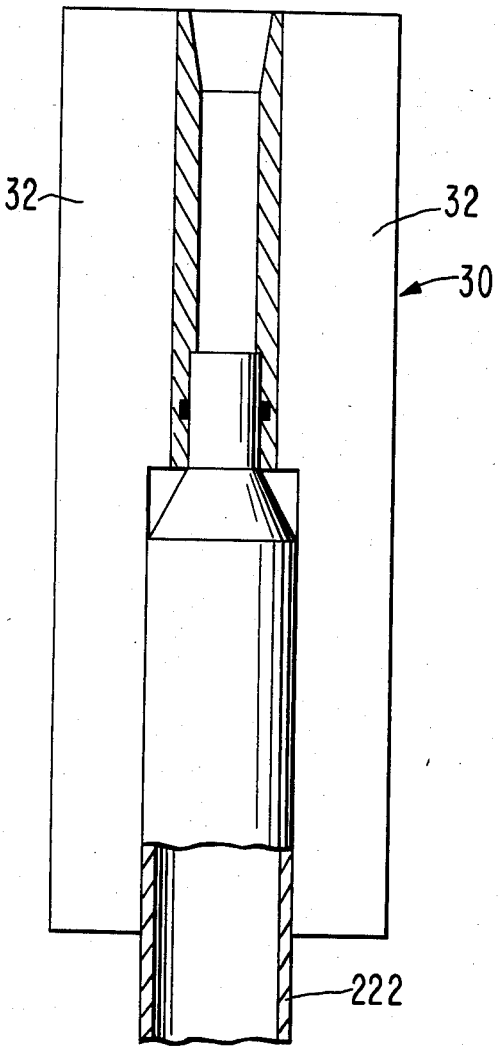
FIG. 4 shows a longitudinal view of FIGS. 2 and 3.

The preferred embodiment of the invention is a finned heat exchange member 30 as shown in FIGS. 1 and 2 which is adapted for close thermal contact with the escaping vapor. A preferred embodiment is designed to couple tightly to the exit of the neck tube assembly 220 providing only a slight extension thereof with corresponding small increase in flow path. The finned member 30 is preferably fabricated by extrusion following well-known procedures. Any number of fins 32 may be employed consistent with the dimensions of the apparatus.

In one practical example, a combined flow of 1.6 liters/min. of $N_2$ was measured from three neck tubes venting the liquid nitrogen reservoir of the above-described cryostat. To each neck tube there was added a finned member, each having twelve radial fins equally spaced, and each contributing approximately 5 inches of flow path. The finned member was constructed of Thermalloy 10910 aluminum extrusion and finished in flat black to enhance the absorbtivity characteristics thereof. The individual fin dimensions of roughly 6 inches$\times$0.85 inches contributes approximately 10.2 square inches (both sides) of absorptive surface for each heat exchanging fin member 32. In environments wherein the measured humidity was great as 80%, the fin members were observed to transfer sufficient heat to the escaping vapor to inhibit noticeable condensation.

It is worth noting that plural neck tubes are common structural features providing structural stability and separately affording a vent through at least one neck tube(s) while filling through another neck tube. It is frequently the practice to vent through only one tube during steady state operation. It has been found in the present work that this practice is disadvantageous. In the example described above, the total flow increased to 1.8 liter/minute when two neck tubes were capped and the boiling gas was channeled through a third neck tube. The reason for the decreased consumption of $LN_2$ with plural vents is believed to arise from the sensible heat of the escaping vapor, which to some extent, intercepts the heat load directed through the venting neck tube(s). Non-venting neck tubes comprise a thermal load undiminished by the sensible heat of the escaping gas.

Figure 3:
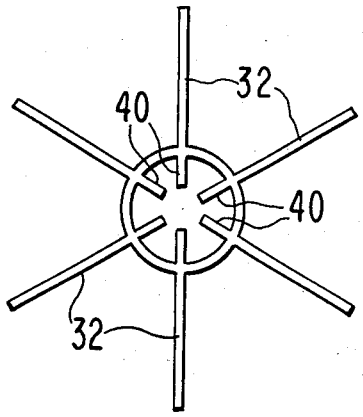
FIG. 3 shows an enhancement for the apparatus of FIG. 2.

In another embodiment, heat exchange to the vapor can be enhanced by inclusion of inner fins 40 extending into the bore of the vent tube as indicated in FIG. 3, or by packing the interior bore space within the heat exchanger with copper wool or copper shavings in contact with the outer wall.

While there have been shown and described and pointed out the fundamental novel features as applied to a preferred embodiment, it will be understood that various omissions and substitutions in form and details of the device illustrated and in its operation may be made by those skilled in the art without departing from the spirit of the invention. It is intended therefore to be limited only as indicated by the scope of the following claims.

What is claimed is:

1. In a cryostat for maintaining a cryogenic liquid at the boiling point thereof, vent means comprising a neck tube protruding exteriorly from said cryostat for permitting vapor of said boiling cryogen to discharge to the atmosphere through an open end thereof and for transferring heat to said vapor prior to discharge, said heat evolved interiorly of said cryostat whereby said vapor is substantially warmed prior to the discharge thereof, ambient heat exchanger means cooperatively disposed with said vent means for transferring heat from the atmosphere to said vent means for further warming said vapor whereby atmospheric condensation on said vent means is minimized, said ambient heat exchanger means comprising tubular means for the passage of said vapor therethrough and a plurality of fins protruding radially from the exterior of said tubular means, said heat exchanger means disposed proximate the open end of said vent means.

* * * * *